US011421633B2

(12) United States Patent
Kuroda et al.

(10) Patent No.: US 11,421,633 B2
(45) Date of Patent: Aug. 23, 2022

(54) OUTBOARD MACHINE

(71) Applicant: HONDA MOTOR CO., LTD., Tokyo (JP)

(72) Inventors: Tatsuya Kuroda, Wako (JP); Yoshihiro Harada, Wako (JP); Tetsuro Ikeno, Wako (JP); Koji Kasai, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 17/440,816

(22) PCT Filed: Jan. 17, 2020

(86) PCT No.: PCT/JP2020/001419
§ 371 (c)(1),
(2) Date: Sep. 20, 2021

(87) PCT Pub. No.: WO2020/202706
PCT Pub. Date: Oct. 8, 2020

(65) Prior Publication Data

US 2022/0186693 A1 Jun. 16, 2022

(30) Foreign Application Priority Data

Mar. 29, 2019 (JP) ..... JP2019-067685

(51) Int. Cl.
*F02M 35/12* (2006.01)
*F02M 35/16* (2006.01)
*F02B 75/22* (2006.01)

(52) U.S. Cl.
CPC ..... *F02M 35/1255* (2013.01); *F02B 75/22* (2013.01); *F02M 35/167* (2013.01)

(58) Field of Classification Search
CPC .... F02M 35/1255; F02M 35/167; F02B 75/22
See application file for complete search history.

(56) References Cited

FOREIGN PATENT DOCUMENTS

JP 09-291861 11/1997
JP 2001336425 A * 12/2001 ..... F02B 61/045

OTHER PUBLICATIONS

International Search Report and Written Opinion for International Application No. PCT/JP2020/001419 dated Mar. 3, 2020, 8 pages.

* cited by examiner

*Primary Examiner* — Jacob M Amick
*Assistant Examiner* — Charles J Brauch
(74) *Attorney, Agent, or Firm* — Amin, Turocy & Watson, LLP

(57) ABSTRACT

This outboard machine has: a V-type engine (engine) in which a plurality of cylinders are arranged in a V-shape when viewed in a plan view; and a cover that covers the engine. The engine has a plurality of intake ports that form pairs in a V-shape inside the plurality of cylinders in a plan view and a concave space is formed between the plurality of intake ports. The cover has therein an intake path that guides air to the intake port, and is also provided with, at a position that is adjacent to the intake path and enters the concave space, a silencer that attenuates the sound during intake.

10 Claims, 5 Drawing Sheets

OUTBOARD MACHINE

TECHNICAL FIELD

The present invention relates to an outboard motor (outboard machine) equipped with a V-type engine inside a cover.

BACKGROUND ART

An outboard motor propels the hull of a ship, by the combustion of fuel by an engine (internal combustion engine) accommodated inside a cover to cause a propeller on a lower side of the outboard motor to be rotated. As the engine for such an outboard motor, for example, a V-type engine is applied in which a plurality of cylinders are arranged in a V-type configuration.

In this type of outboard motor, for example, as disclosed in JP H09-291861 A, a silencer (intake resonator unit) is installed in a peripheral part of the V-type engine, thereby suppressing air noises at a time of air intake. The air intake system structure disclosed in JP H09-291861 A is equipped with a silencer on an upper part of the V-type engine.

SUMMARY OF INVENTION

Incidentally, an outboard motor includes, on an upper part thereof, an air intake duct and a throttle body in order to perform intake of air, and therefore, it is difficult to secure a sufficient space for installation of the silencer, and the effect of suppressing air noise is lowered. Further, if a large silencer is installed, the outboard motor itself becomes large in size. In particular, when installing a silencer, a mounting component therefor becomes necessary, and it is essential to secure an installation space in which a mounting location is included.

The present invention relates to a technique for the above-described outboard motor having a V-type engine, and has the object of providing an outboard motor which is capable of easily securing a space for the silencer and significantly suppressing air noises at a time of air intake, and further, is capable of promoting a reduction in the size of the outboard motor itself.

In order to achieve the aforementioned objects, one aspect of the present invention is characterized by an outboard motor, comprising a V-type engine in which a plurality of cylinders are arranged laterally, and the plurality of cylinders exhibit a V-shape in plan view, and a cover configured to cover the V-type engine, wherein the V-type engine includes a plurality of air intake ports paired in a V-shape on an inner side of the plurality of cylinders, and a concave space is formed between the plurality of air intake ports, the cover includes, on an outer side of the air intake ports and the concave space, an air intake path configured to guide air to the air intake ports, and the outboard motor further comprises, at a position adjacent to the air intake path and within the concave space, a silencer configured to attenuate sound at a time of air intake.

In the above-described outboard motor, a space for installing the silencer can be easily secured on a side portion of the V-type engine. In particular, since the outboard motor includes the plurality of V-shaped air intake ports that are paired in a V-shape, and the air intake path on the outer side of the concave space between them, the components arranged in the concave space apart from the silencer are eliminated or become few in number, and it becomes possible to install a silencer of a sufficient size. Therefore, the silencer is capable of significantly suppressing air noises at a time of air intake. Further, the outboard motor can be made slimmer around the sides of the V-type engine, and for example, even if an engine having a large output is mounted, it is possible to promote a reduction in the size of the outboard motor itself.

DESCRIPTION OF EMBODIMENTS

Hereinafter, a description will be presented and described in detail below with reference to the accompanying drawings concerning an embodiment of the present invention.

Figure 1:
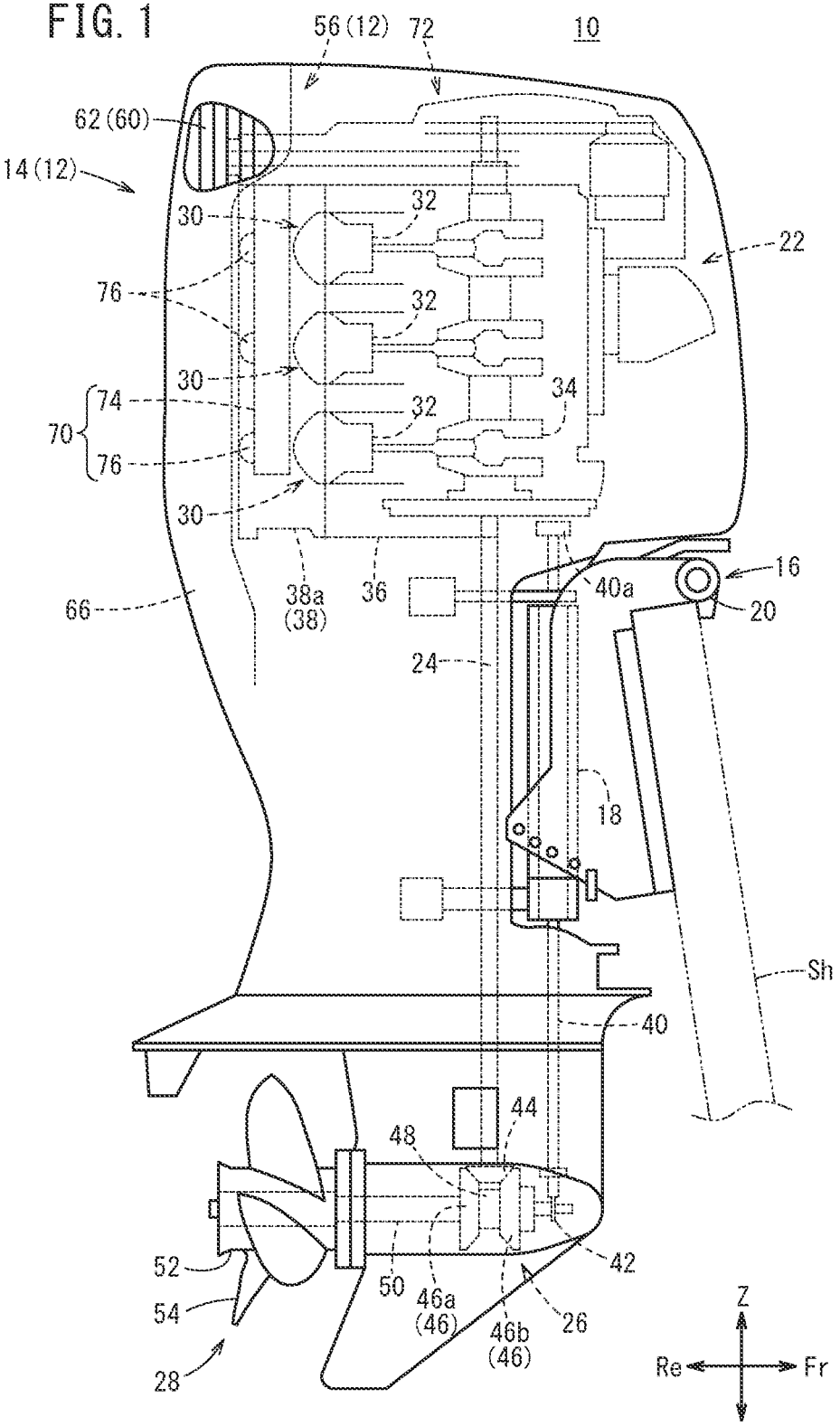
FIG. 1 is a schematic side view showing an overall configuration of an outboard motor according to an embodiment of the present invention.

As shown in FIG. 1, an outboard motor 10 according to the embodiment of the present invention is attached to a hull Sh as a power source for a small sized ship or the like, and is driven under the operation of a user to thereby propel the hull Sh. The outboard motor 10 is equipped with a cover 12 in which respective components of the outboard motor 10 are accommodated, and a mounting mechanism 16 that is disposed on a front side (in the direction of the arrow Fr) of the cover 12 and fixes the outboard motor 10 to the hull Sh.

The mounting mechanism 16 enables the cover 12 to be swung to the left and right about a swivel shaft 18 in plan view, and further enables the cover 12 to be rotated about a tilt shaft 20 in a clockwise or counterclockwise direction shown in FIG. 1. The outboard motor 10 allows a propeller (fins 54) to be positioned below a water surface, in a state in which an upper-lower direction of the cover 12 extends substantially in a vertical direction. Hereinafter, the position and direction of the respective components will be described based on the posture of the outboard motor 10 shown in FIG. 1.

An engine 22 (internal combustion engine), a drive shaft 24, a gear mechanism 26, and a propeller mechanism 28 are provided inside the cover 12. Further, the cover 12 includes an outer cover 14 that makes up the external appearance of the outboard motor 10, and an inner cover 56 that covers the engine 22 on an inner side of the outer cover 14. A description will be given later concerning the configuration of the cover 12 (the outer cover 14 and the inner cover 56).

Further, the outboard motor 10 includes, in a lower part of the engine 22, a non-illustrated exhaust system that allows the exhaust gas from the engine 22 to flow therethrough, and a non-illustrated cooling structure for cooling the engine 22 and the exhaust gas. The cooling structure may include, for example, a silencing function for reducing exhaust noises of the exhaust gas, by causing cooling water (water such as seawater or freshwater taken from the outside of the outboard motor 10) to flow around the periphery of an exhaust pipe (not shown) for the exhaust gas.

As the engine 22, a multi-cylinder engine having a plurality of cylinders 30 arranged along the upper/lower direction of the outboard motor 10 (the cover 12) is applied. The engine 22 is arranged so that axial lines of the respective cylinders 30 are arranged laterally (in a substantially horizontal direction), and a crankshaft 34 connected to piston rods 32 of the cylinders 30 is extended in the upper/lower direction. Further, a cooling water jacket (not shown) for cooling the engine 22 by having the cooling water of the cooling structure flow therethrough is provided on a cylinder block 36 and a cylinder head 38 of the engine 22.

The cylinder head 38 includes, on the side of the engine 22, a pair of banks 38*a* which alternately accommodate the plurality of cylinders 30 arranged alongside one another in the upper-lower direction. Additionally, the engine 22 according to the present embodiment is constituted in the form of a V-type engine in which the pair of banks 38*a* (and the plurality of cylinders 30) exhibit a V-shape in plan view (refer also to FIG. 4). The angle between the pair of banks 38*a* is not particularly limited, but is set to an appropriate angle at which the size of the engine 22 can be reduced insofar as possible and a later-described silencer 80 can be arranged. The number of cylinders 30 installed in the engine 22 is not particularly limited, and can be set to a number at which a desired driving force (horsepower) can be obtained in the outboard motor 10.

The crankshaft 34 of the engine 22 is connected to an upper end of the drive shaft 24. The drive shaft 24 extends in the upper-lower direction inside the outer cover 14, and rotates about the axis thereof accompanying rotation of the crankshaft 34. A lower end of the drive shaft 24 is accommodated in the gear mechanism 26.

The gear mechanism 26 switches the driving force of the engine 22 under the operation of an operating shaft 40, thereby causing the propeller mechanism 28 to rotate, and causing the hull Sh to be moved forward or rearward. The operating shaft 40 is rotated, for example, by a shift actuator 40*a* that is driven in response to a shift operation made by the user.

The gear mechanism 26 causes a shift slider 42 to be advanced and retracted in an axial direction of the propeller mechanism 28 (propeller shaft 50) by rotation of the operating shaft 40. Consequently, the shift slider 42 causes a dog clutch 48 to be moved between a pair of driven bevel gears 46 (a forward driven bevel gear 46*a* and a rearward driven bevel gear 46*b*) that mesh with a driving bevel gear 44 connected to the drive shaft 24. In addition, a tooth surface of the dog clutch 48 meshes with either an inner tooth surface of the forward driven bevel gear 46*a* or an inner tooth surface of the rearward driven bevel gear 46*b*, whereby the driving force of the engine 22 is transmitted to the propeller mechanism 28 via the dog clutch 48 and the later-described propeller shaft 50.

The propeller mechanism 28 includes the tubular-shaped propeller shaft 50 into which the shift slider 42 is inserted, a tubular body 52 connected to an outer side in a radial direction of the propeller shaft 50, and a plurality of fins 54 connected to an outer peripheral surface of the tubular body 52. The propeller mechanism 28 rotates the respective fins 54 in a clockwise or counterclockwise direction about the propeller shaft 50 which is rotated by the gear mechanism 26, thereby causing the hull Sh to be moved forward or rearward.

As discussed previously, the above-described outboard motor 10 includes the inner cover 56 (an engine case) on an inner side of the outer cover 14 at a location where the engine 22 is accommodated. The inner cover 56 is joined to the outer cover 14 and covers a rearward side (refer to the arrow Re in FIG. 1) of the engine 22. Moreover, the inner cover 56 may be configured to cover the entirety (an upper part, side parts, a front part, etc.) or another portion of the engine 22.

Further, an air intake structure 60 for taking in air used for combustion of fuel inside the engine 22 is provided in the outboard motor 10. The air intake structure 60 includes air intake ports 62 formed in an upper part of the outer cover 14, and an air intake path 64 that communicates with the air intake ports 62 and allows air to flow inside the outer cover 14.

Figure 2:
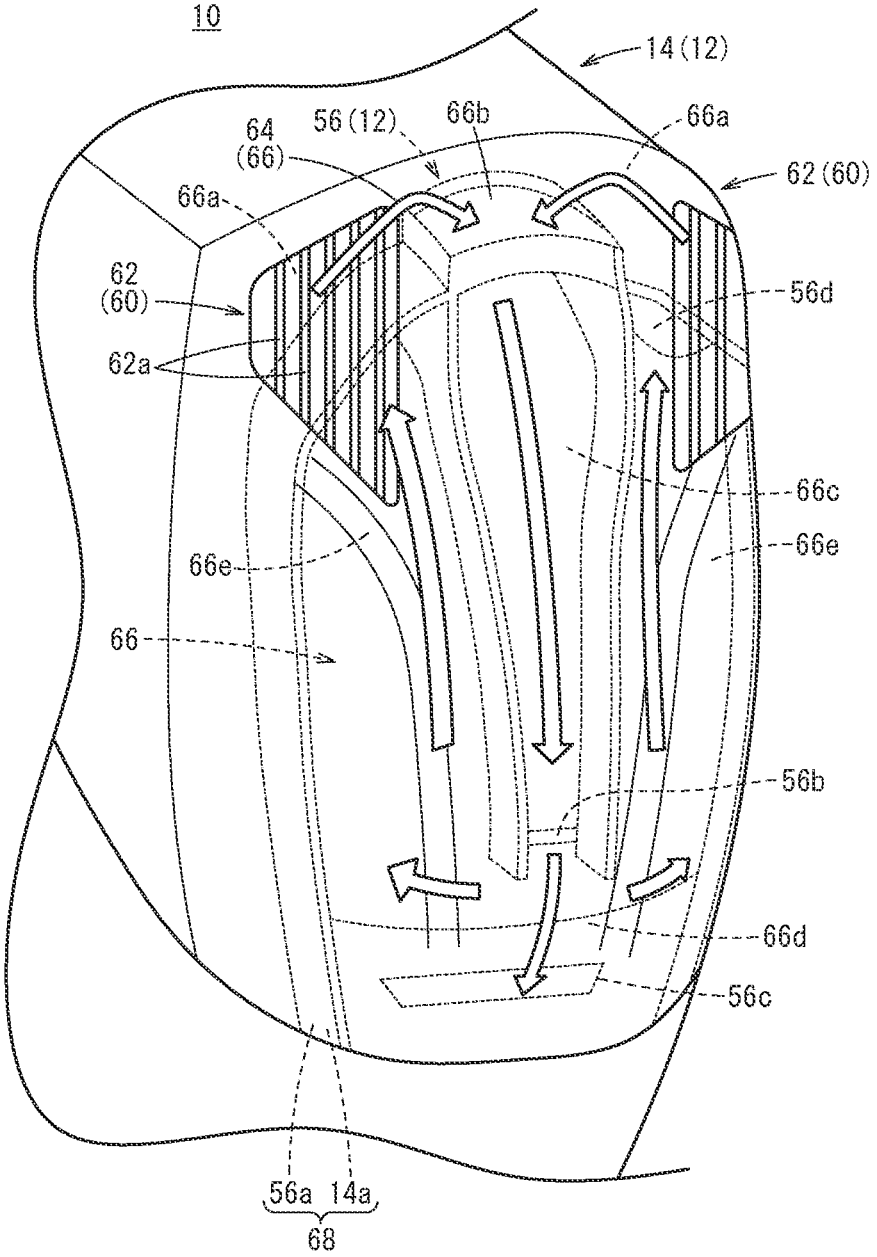
FIG. 2 is an explanatory diagram showing an air flow path in a rearward space formed between an outer cover and an inner cover.

As shown in FIGS. 1 and 2, a pair of the air intake ports 62 are provided on both surfaces of the outer cover 14 in the widthwise direction, on the rearward side thereof. Louvers 62*a* (nets, grids, or the like), which serve to suppress inflowing of foreign matter (water or the like) apart from air into the air intake path 64, are attached to each of the air intake ports 62.

The air intake path 64 is configured to allow air to flow through a rearward space 66 formed between the outer cover 14 and the inner cover 56, and thereafter, to introduce the air from above the engine 22 into an air intake pipe 70 of the engine 22. More specifically, the rearward space 66 includes a pair of first spaces 66*a* formed on both sides in the widthwise direction and directly communicating with the air intake ports 62, a second space 66*b* communicating with the first spaces 66*a* on an inner side in the widthwise direction (the center in the widthwise direction) of the pair of first spaces 66*a*, a third space 66*c* communicating with a lower side of the second space 66*b* and extending downward in an elongate manner, a fourth space 66*d* that constitutes a space on a lower side of the rearward space 66 by communicating with a lower side of the third space 66*c* and spreading outward in the widthwise direction, and a pair of fifth spaces 66*e* communicating with an upper side of the fourth space 66*d* and positioned on a lower side of the first spaces 66*a* and on outer sides of the third space 66*c* in the widthwise direction.

The outer cover 14 and the inner cover 56 form a partition wall 68 having an appropriate shape inside the rearward space 66, thereby defining other spaces while communicating sequentially with the first to fifth spaces 66*a* to 66*e*. The partition wall 68 is configured by mutually connecting projecting pieces 14*a* that project out from an inner surface of the outer cover 14, and projecting pieces 56*a* that project out from an outer surface (an opposite surface to a surface facing toward the engine 22) of the inner cover 56 (refer also to FIG. 4).

Air that has flowed into the rearward space 66 (the air intake path 64) from the respective air intake ports 62 initially enters the pair of first spaces 66*a*. A lower side of each of the first spaces 66*a* is demarcated from each of the fifth spaces 66*e* by the partition wall 68, and air flows from each of the first spaces 66*a* into the second space 66*b* in the center in the widthwise direction.

The second space 66*b* is formed above and at a higher position than the first spaces 66*a* by the partition wall 68 having a rectangular shape. More specifically, the air in the first spaces 66*a* flows upwardly toward the second space 66*b* so as to flow beyond the partition wall 68, and after having flowed beyond the partition wall 68, the air flows downward (toward the third space 66*c*) inside the second space 66*b*.

The air that has flowed from the second space 66*b* into the third space 66*c* flows downward within a central portion of the rearward space 66 in the widthwise direction. The partition wall 68 constituting the third space 66*c* extends downward in an elongate manner as a pair from the partition wall 68 constituting the second space 66*b*, and air also flows downward in an elongate manner within the rearward space 66. In a lower part of the third space 66*c*, an inner cover side opening 56*b* is provided, which allows the air to flow through the later-described silencer 80.

The air that has flowed from the third space 66*c* into the fourth space 66*d* flows while spreading from the central portion of the rearward space 66 in the widthwise direction to both sides thereof in the widthwise direction. Further, in a lower part of the fourth space 66*d*, there is provided a hole portion 56*c* for drainage of water that has flowed into the air intake path 64 from the air intake ports 62. Water that has flowed into the rearward space 66 and is guided to the hole portion 56*c* is discharged to the cooling structure provided on the lower side of the engine 22. Further, a portion of the air in the fourth space 66*d* flows into the hole portion 56*c*, and flows to the inner side of the inner cover 56 (refer also to FIG. 3).

Air that has gone wrapped around the outer side of the fourth space 66*d* in the widthwise direction flows into the pair of fifth spaces 66*e*, and flows upwardly in the fifth spaces 66*e*. Then, the pair of fifth spaces 66*e* allow the air to flow out from a pair of outlets 56*d* provided on the upper side of the inner cover 56 to the inner side (front side) of the inner cover 56.

Figure 3:
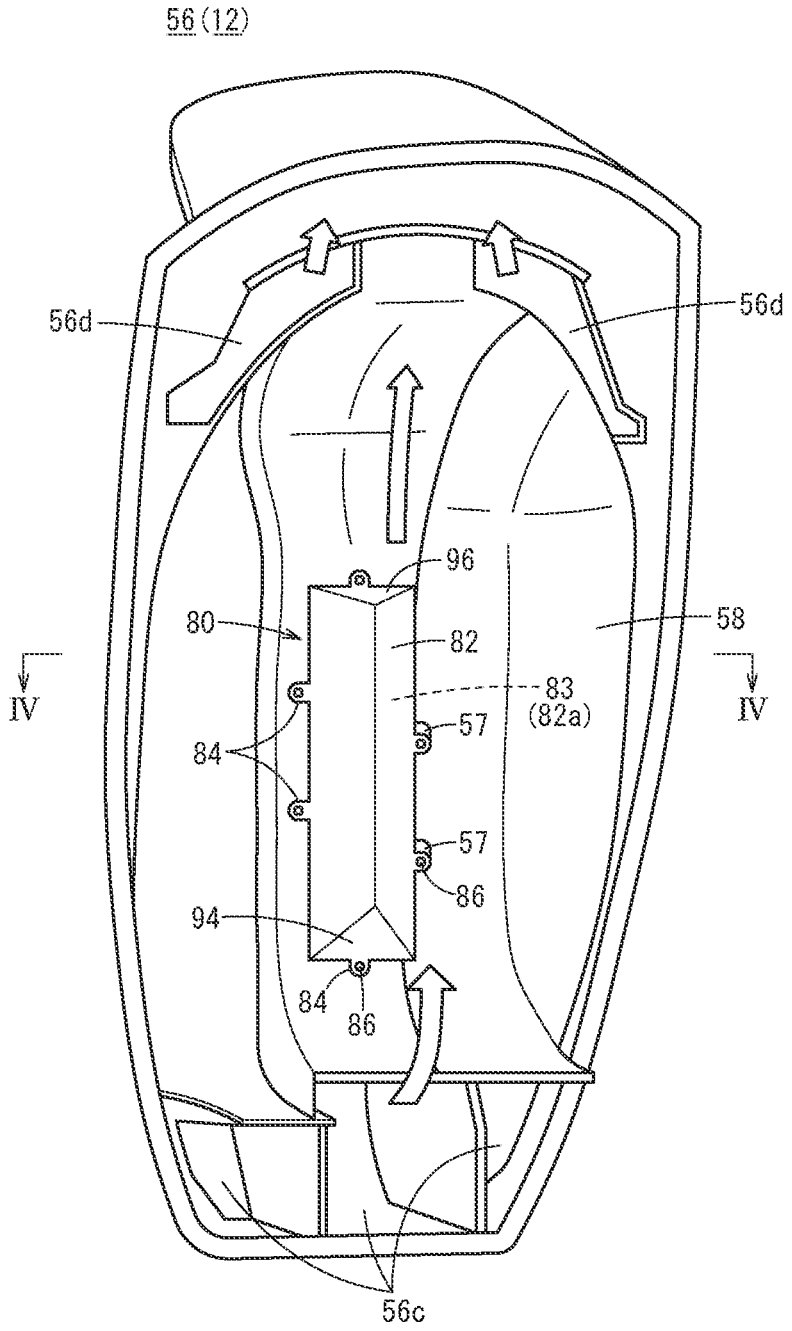
FIG. 3 is a perspective view of the inner cover as observed from an inner surface side thereof.

More specifically, as shown in FIG. 3, the inner cover 56 allows the air to flow through the entirety of the rearward space 66, and then allows the air to flow from above (the outlets 56*d*) and below (the hole portion 56*c*) to the inner side (front) of the inner cover 56. The air that has flowed from the hole portion 56*c* of the inner cover 56 flows upwardly between an inner surface 58 of the inner cover 56 and the engine 22, and merges with the air that has flowed from the outlets 56*d*.

Returning to FIG. 1, in front of the outlets 56*d* of the inner cover 56, a structure 72 of the air intake path 64 through which air is taken into the air intake pipe 70 of the engine 22 is provided, and the aforementioned merged air flows into the structure 72 from a non-illustrated inflow port. The structure 72 is one in which, for example, a throttle body and a valve gear for the engine 22 (neither of which is shown) are integrally constructed. Further, the structure 72 may include the function of a silencer that suppresses air noises at a time that air is taken in at a location upwardly of the engine 22. The structure 72 allows the air to flow through a predetermined internal path, and thereafter, allows the air to flow into the air intake pipe 70 via the throttle body.

Figure 4:
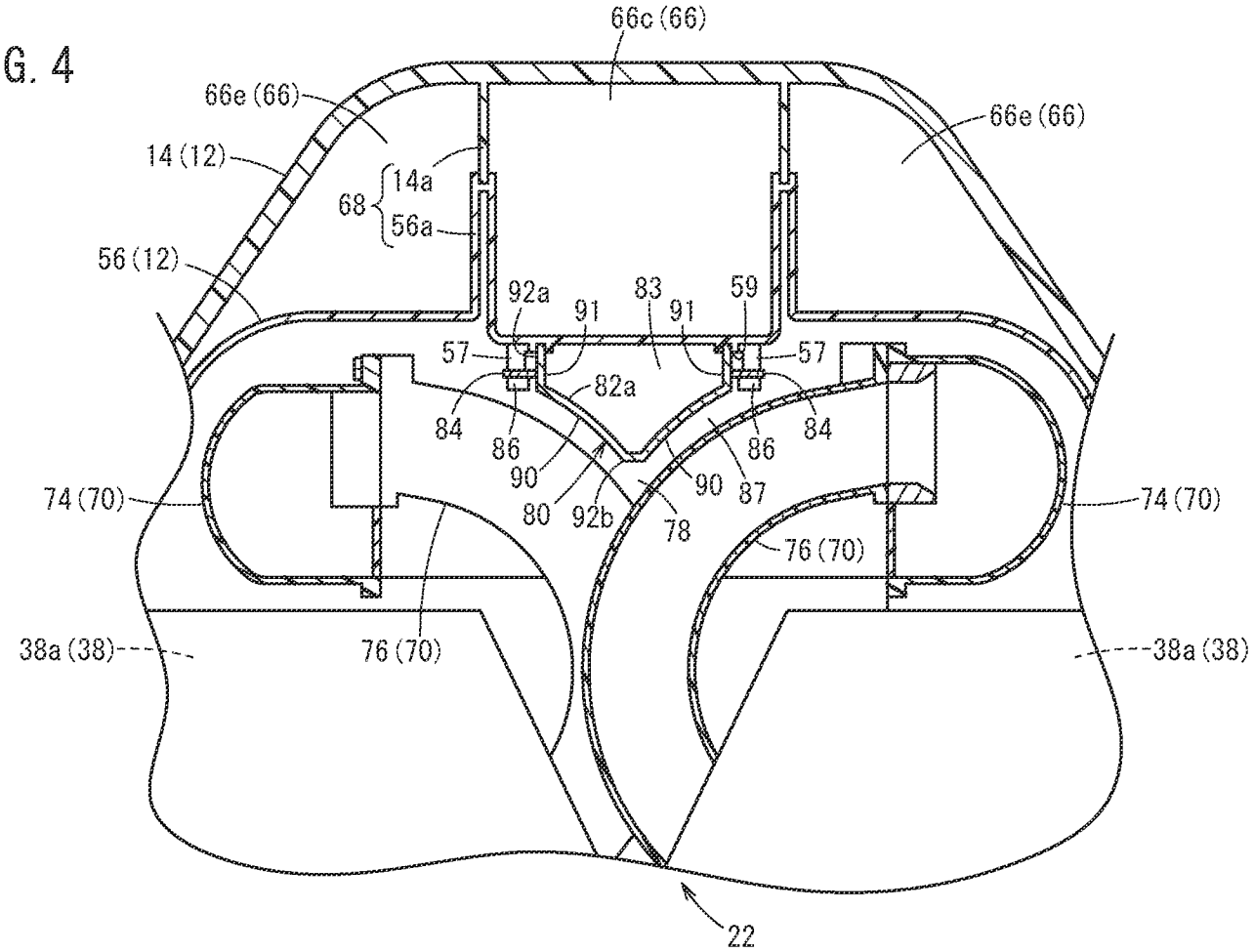
FIG. 4 is a cross-sectional view taken along line IV-IV of FIG. 3.

In this instance, as discussed previously, a V-type engine in which the pair of banks 38*a* exhibit a V-shape in plan view is applied as the engine 22, and the air intake pipe 70 that supplies air to the engine 22 is configured to be capable of supplying air to each of the cylinders 30 inside the pair of banks 38*a*. More specifically, as shown in FIGS. 1 and 4, the air intake pipe 70 includes inlet manifolds 74 that communicate with the throttle body and extend downward from the structure 72 positioned in the upper part, and a plurality of air intake ports 76 connected from the inlet manifolds 74 to the cylinders 30.

For example, the inlet manifolds 74 are provided as a pair on both sides of a housing for the engine 22 in the widthwise direction, on a rearward side of the pair of banks 38*a*, and supply air flowing from the structure 72 to each of the air intake ports 76.

The plurality of air intake ports 76 make up an inner side air intake system, which supplies air into the cylinders 30 from the inner side of the pair of banks 38*a* in the engine 22. The respective air intake ports 76 extend in directions perpendicular to the direction of extension of the pair of inlet manifolds 74, and are connected to the respective cylinders 30. In greater detail, the respective air intake ports 76 extend alternately from the pair of inlet manifolds 74 along the upper-lower direction of the engine 22, and by extending to the inner side in the widthwise direction of the inlet manifolds 74 while being curved toward the front side, and being wrapped around to the inner side in the central portion in the widthwise direction, the air intake ports 76 are connected to corresponding ones of the cylinders 30. The arcuate shape of the respective air intake ports 76 is set to have an appropriate curvature that enables the air to flow smoothly.

Accordingly, the plurality of air intake ports 76 of the engine 22 are paired in the widthwise direction in plan view, and exhibit a substantially V-shape as a whole. Therefore, in a central portion of the air intake pipe 70 in the widthwise direction, a substantially triangular concave space 78 is formed by the paired air intake ports 76. In addition, in the outboard motor 10 according to the present embodiment, the silencer 80 (resonator), which reduces air intake noises at a time that air is taken into the engine 22, is disposed in the concave space 78. Hereinafter, a description will be given concerning the configuration of the silencer 80.

As shown in FIGS. 3 and 4, the silencer 80 includes a main body portion 82 formed in a three-dimensional shape (a bowl-like shape having a recessed part 82*a* on an inner side thereof) which is elongated in the upper-lower direction, and a plurality of mounting pieces 84, which project out toward outer sides in the widthwise direction from the main body portion 82, and constitute portions for mounting the main body portion 82 to the inner cover 56. By the main body portion 82 being mounted to the inner cover 56, the recessed part 82*a* of the main body portion 82 forms a hollow portion 83 through which air is capable of flowing. It should be noted that the main body portion 82 may also be independently formed in a tubular shape by itself.

The main body portion 82 is installed on the inner cover 56 in a manner so that the longitudinal direction (direction of extension) thereof lies along the upper-lower direction of the outboard motor 10. The respective mounting pieces 84 include screw holes (not shown) in which bolts 86 are fastened, and are firmly fixed via the bolts 86 to a plurality of screw-fixing portions 57 formed on the inner surface 58 on the front side of the inner cover 56. The means for installing the main body portion 82 is not particularly limited, and the main body portion 82 may also be fixed by welding, adhesion, or the like.

The total length of the main body portion 82 (the silencer 80) in the longitudinal direction is set to a length that causes air intake noises of the air of the engine 22 to be attenuated corresponding to a frequency of the air intake noises. More specifically, by the air flowing reciprocally in the hollow portion 83 of the main body portion 82, the silencer 80 shifts the phase of the frequency of the air intake noises by ½ wavelength and returns them to an original branching point (the inner cover side opening 56*b*), and makes the phase of the frequency thereof opposite to that of the frequency of the air in the third space 66*c*, thereby suppressing the air intake noises.

For example, the total length of the main body portion 82 may be set within the same range as the plurality of air intake ports 76 that are arranged alongside one another in the upper-lower direction. In other words, an upper end of the main body portion 82 is at the same height (position in the upper-lower direction) as the air intake port 76 located on an uppermost end among the plurality of air intake ports 76, and a lower end of the main body portion 82 is at the same height as the air intake port 76 located on a lowermost end among the plurality of air intake ports 76. By being set in this manner within the same range as that of the side-by-side arrangement of the plurality of air intake ports 76, the silencer 80 is capable of satisfactorily causing the air intake noises of a predetermined wavelength to be attenuated.

Figure 5:
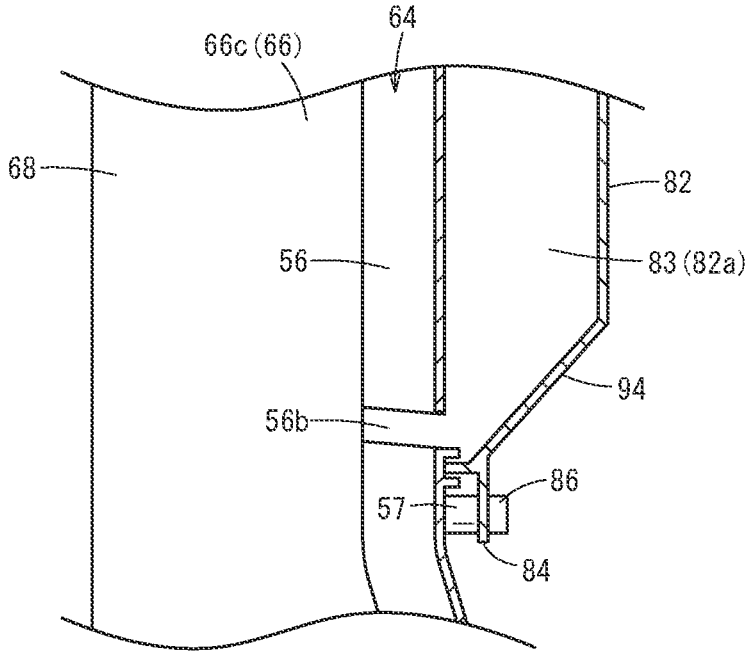
FIG. 5 is a side cross-sectional view showing a lower end part of a silencer.

Further, as shown in FIGS. 4 and 5, the main body portion 82 is installed on the inner cover 56 in a manner so that the lower end part (one end part in the longitudinal direction) thereof overlaps with the inner cover side opening 56*b*. Accordingly, the hollow portion 83 of the silencer 80 communicates with the third space 66*c* of the rearward space 66 via the inner cover side opening 56*b*, and the air is capable of flowing in and flowing out between the third space 66*c* and the hollow portion 83. Further, by being positioned at the lower end part of the silencer 80, the inner cover side opening 56*b* also functions as a drainage hole for allowing water that has flowed into the hollow portion 83 to flow out (be drained from the hollow portion 83) due to its own weight. Moreover, the positional relationship between the main body portion 82 and the inner cover side opening 56*b* is not particularly limited, and for example, the inner cover side opening 56*b* may also be positioned at an upper end part of the main body portion 82.

Furthermore, at one end part (the lower end part) of the main body portion 82 in the longitudinal direction, a wall portion 94 is provided, which is inclined at 45° with respect to the direction of extension (longitudinal direction, axial direction) of the main body portion 82. The inner cover side opening 56*b* faces toward the wall portion 94 on a lower side thereof. The wall portion 94 guides the air noises that have flowed into the hollow portion 83 upwardly from the inner cover side opening 56*b*, and discharges the air noises that have flowed downward inside the hollow portion 83, from the perpendicularly disposed inner cover side opening 56*b*.

On the other hand, a wall portion 96, which is disposed at another end part (the upper end part) of the main body portion 82 in the longitudinal direction, lies perpendicular to the direction of extension of the main body portion 82, and closes the hollow portion 83. Stated otherwise, the wall portion 94 faces toward the wall portion 96 while being inclined at 45° with respect to the wall portion 96. Consequently, the wall portion 94 reflects the air noises, which have flowed in the direction of extension inside the hollow portion 83, as they are in an opposite direction.

In addition, the silencer 80 is installed in a manner so as to enter the concave space 78 between the air intake ports 76 that are paired in a V-shape in plan view (in a cross-sectional view perpendicular to the axial direction of the main body portion 82).

In a cross-sectional view perpendicular to the longitudinal direction, the main body portion 82 of the silencer 80 is formed, together with the inner cover 56 to which the main body portion 82 is mounted, in a substantially pentagonal shape including two surface portions 90 forming a shape that resembles (is similar to) the shape of the paired air intake ports 76. More specifically, in plan view, the main body portion 82 includes a rectangular region 92*a* constituted by the inner cover 56 on the rearward side, and a pair of surface portions 91 that project a short distance from the inner cover 56. The pair of surface portions 91 are inserted into mounting groove portions 59 of the inner cover 56, and thereby seal the hollow portion 83 (the recessed part 82*a*).

Further, the main body portion 82 includes, on the front side of the rectangular region 92*a*, a triangular region 92*b* which is constituted by the two surface portions 90 connected to the pair of surface portions 91 and inclined frontward toward the inner side in a widthwise direction. The hollow portion 83 also is formed in a pentagonal shape, which coincides with the rectangular region 92*a* and the triangular region 92*b* of the main body portion 82.

The two surface portions 90 are formed as curved surfaces having a curvature that substantially coincides with the curvature of the air intake ports 76 existing in the vicinity thereof, whereby in a state in which the silencer 80 is installed, a gap 87 which is parallel to the air intake ports 76 is formed between the surface portions 90 and the paired air intake ports 76. Stated otherwise, in the main body portion 82, the triangular region 92*b*, which corresponds to the shape of the concave space 78 in plan view, enters the concave space 78, whereby the hollow portion 83 is constituted in which the flow path cross-sectional area for the air is sufficiently large, while a non-contacting property of the silencer 80 is maintained.

The outboard motor 10 according to the present embodiment is basically configured in the manner described above. Hereinafter, a description will be given concerning operations of the outboard motor 10.

As shown in FIGS. 1 and 2, when the engine 22 is driven, the outboard motor 10 draws in air from the outside of the outer cover 14 via the air intake ports 62, and causes the air to flow along the air intake path 64 inside the outer cover 14. When the air at the time of air intake passes through the third space 66*c* of the rearward space 66 (the air intake path 64), a portion of such air flows into the hollow portion 83 of the silencer 80 via the inner cover side opening 56*b*.

As shown in FIGS. 3 to 5, vibrations (air noises) of the air flowing into the hollow portion 83 from the inner cover side opening 56*b* impinge against the wall portion 94. As a result, the air noises are reflected so as to be directed upward in the hollow portion 83, and upon advancing upwardly in the hollow portion 83, the air noises impinge against the wall portion 96 of the upper end part of the silencer 80 and are reflected in the opposite direction. Then, the phase of the wavelength of the air noises that are returned downward inside the hollow portion 83 becomes, at a position of being output from the inner cover side opening 56*b*, reverse to that of the vibratory wavelength of the air flowing in the air intake path 64, and the air noises at the time of air intake are attenuated.

Further, as shown in FIGS. 2 and 3, the air that has passed through the third space 66*c* flows through the fourth space 66*d*, the fifth spaces 66*e*, and the like, and then flows to the inner side (front side) of the inner cover 56 via the hole portion 56*c* and the outlets 56*d*. Then, as shown in FIG. 1, the air that has flowed on the inner side of the inner cover 56 flows into the structure 72, passes through the throttle body, and flows into the air intake pipe 70. The air is supplied to each of the cylinders 30 of the engine 22 via the inlet manifolds 74 and the air intake ports 76, and is used to bring about combustion in the engine 22. The engine 22 causes the fins 54 to be rotated under the combustion of the fuel, thereby propelling the hull Sh.

A description will be given below concerning the technical concepts and advantageous effects capable of being grasped from the above-described embodiments.

One aspect of the present invention is characterized by the outboard motor 10 comprising the V-type engine (engine 22) in which the plurality of cylinders 30 are arranged laterally, and the plurality of cylinders 30 exhibit a V-shape in plan view, and the cover 12 that covers the V-type engine, wherein the V-type engine includes the plurality of air intake ports 76 that are paired in a V-shape on the inner side of the plurality of cylinders 30, and the concave space 78 is formed between the plurality of air intake ports 76, the cover 12 includes, on the outer side of the air intake ports 76 and the concave space 78, the air intake path 64 that guides the air to the air intake ports 76, and the outboard motor further comprises, at a position adjacent to the air intake path 64 and within the concave space 78, the silencer 80 that attenuates sound at the time of air intake.

In the outboard motor 10, a space for installing the silencer 80 can be easily secured on a side portion of the engine 22. In particular, since the outboard motor 10 includes the plurality of air intake ports 76 that are paired in a V-shape, and the air intake path 64 on the outer side of the concave space 78 between them, the components arranged in the concave space 78 apart from the silencer 80 are eliminated or become few in number, and it becomes possible to install the silencer 80 having a sufficient size. Therefore, the silencer 80 is capable of significantly suppressing air noises at the time of air intake. Further, the outboard motor 10 can be made slimmer around the sides of the engine 22, and for example, even if an engine having a large output is mounted, it is possible to promote a reduction in the size of the outboard motor 10 itself.

Further, the silencer 80 includes the main body portion 82 that extends in an elongate manner in a predetermined direction, and includes, on an inner side thereof, the hollow portion 83 through which the air is capable of flowing, and the air flows in or flows out of the hollow portion 83 through an opening (the inner cover side opening 56*b*) positioned at one end part of the main body portion 82 in the longitudinal direction. In accordance with such features, in the case that the air is made to flow into the hollow portion 83 from the inner cover side opening 56*b*, a sufficient flow length for the air can be provided, and the silencer 80 can more satisfactorily attenuate air noises.

Further, the silencer 80 is installed in a manner so that an extending posture of the main body portion 82 in the longitudinal direction is along the upper-lower direction of the cover 12, and the opening (the inner cover side opening 56*b*) is positioned at a lower end part of the main body portion 82. In accordance with such features, the outboard motor 10 enables the silencer 80 to be disposed along the plurality of cylinders 30 that are arranged alongside one another in the upper-lower direction of the cover 12, and it becomes possible to suppress the air noises while achieving a further reduction in size.

Further, the opening (the inner cover side opening 56*b*) also serves as a drainage hole. In accordance with this feature, even if water flows into the hollow portion 83 of the main body portion 82, the water can be discharged from the inner cover side opening 56*b*, whereby the effect of suppressing the air noises by the silencer 80 can be stably continued, and it is possible to suppress corrosion from occurring to the silencer 80.

Further, the one end part of the main body portion 82 in the longitudinal direction is provided with the wall portion 94 inclined at 45° with respect to the direction of extension of the main body portion 82 and facing toward the opening (the inner cover side opening 56*b*). In accordance with such features, when air noises which have flowed from the inner cover side opening 56*b* to the hollow portion 83 impinge against the wall portion 94, the silencer 80 satisfactorily causes the air noises to proceed straight ahead in the hollow portion 83. As a result, the phase of the wavelength of the air noises inside the hollow portion 83 is capable of being reversed at the inner cover side opening 56*b*.

Further, the main body portion 82 includes the two surface portions 90 forming a shape that is similar to the V-shape formed by the paired air intake ports 76, as viewed in cross-section perpendicular to the longitudinal direction. In accordance with this feature, concerning the silencer 80, a sufficiently large flow path cross-sectional area can be obtained in the concave space 78, and it is possible to even further suppress the air noises.

Further, the gap 87 is formed between the air intake ports 76 and the two surface portions 90 of the main body portion 82. In accordance with this feature, the outboard motor 10 is capable of assuring that the silencer 80 and the air intake ports 76 are not in contact with each other, and by allowing a portion of the air at the time of air intake to flow through the gap 87, it becomes possible to carry out intake of air while cooling the engine 22.

Further, the length of the silencer 80 in the direction of extension thereof is set to a length that causes sound of a predetermined frequency to be attenuated. In accordance with this feature, the silencer 80 is capable of effectively suppressing the air noises at the time of air intake.

Further, the cover 12 includes the outer cover 14 that makes up the external appearance of the outboard motor 10, and the inner cover 56 that covers the rear side of the V-type engine (engine 22) on the inner side of the outer cover 14, and further, the silencer 80 is mounted to the inner surface 58 of the inner cover 56, the inner surface 58 facing toward the V-type engine. In accordance with such features, the outboard motor 10 is capable of suppressing the air noises by disposing the silencer 80 on the inner cover 56 in close proximity to the engine 22.

Further, the rearward space 66 constituting the air intake path 64 is disposed between the outer cover 14 and the inner cover 56, and the silencer 80 is configured to attenuate the air noises by drawing in the air flowing in the rearward space 66. In accordance with such features, the outboard motor 10 is capable of satisfactorily suppressing the air noises by the silencer 80, while cooling the inner cover 56 that covers the engine 22 by the air flowing through the rearward space 66.

What is claim is:

1. An outboard motor, comprising:

a V-type engine in which a plurality of cylinders are arranged laterally, and the plurality of cylinders exhibit a V-shape in plan view; and a cover configured to cover the V-type engine, wherein the V-type engine includes a plurality of air intake ports paired in a V-shape on an inner side of the plurality of cylinders, and a concave space is formed between the plurality of air intake ports, the cover includes, on an outer side of the air intake ports and the concave space, an air intake path configured to guide air to the air intake ports, and the outboard motor further comprises, at a position adjacent to the air intake path and within the concave space, a silencer configured to attenuate sound at a time of air intake.

2. The outboard motor according to claim 1, wherein the silencer comprises a main body portion extending in an elongate manner in a predetermined direction, and includes, on an inner side thereof, a hollow portion through which the air is allowed to flow, and the air flows in or flows out of the hollow portion through an opening positioned at one end part of the main body portion in a longitudinal direction thereof.

3. The outboard motor according to claim 2, wherein the silencer is installed in a manner so that an extending posture of the main body portion in the longitudinal direction is along an upper-lower direction of the cover, and the opening is positioned at a lower end part of the main body portion.

4. The outboard motor according to claim 3, wherein the opening also serves as a drainage hole.

5. The outboard motor according to claim 2, wherein the one end part of the main body portion in the longitudinal direction is provided with a wall portion inclined at 45° with respect to a direction of extension of the main body portion and facing toward the opening.

6. The outboard motor according to claim 2, wherein the main body portion includes two surface portions forming a shape that is similar to the V-shape formed by the paired air intake ports, as viewed in cross-section perpendicular to the longitudinal direction.

7. The outboard motor according to claim 6, wherein a gap is formed between the air intake ports and the two surface portions of the main body portion.

8. The outboard motor according to claim 1, wherein a length of the silencer in a direction of extension thereof is set to a length that causes sound of a predetermined frequency to be attenuated.

9. The outboard motor according to claim 1, wherein the cover includes an outer cover making up an external appearance of the outboard motor, and an inner cover configured to cover a rear side of the V-type engine on an inner side of the outer cover, and the silencer is mounted to an inner surface of the inner cover, the inner surface facing toward the V-type engine.

10. The outboard motor according to claim 9, wherein a rearward space constituting the air intake path is disposed between the outer cover and the inner cover, and the silencer attenuates air noises by drawing in air flowing in the rearward space.

* * * * *